US008511677B2

(12) United States Patent
Uchino

(10) Patent No.: US 8,511,677 B2
(45) Date of Patent: Aug. 20, 2013

(54) SHEET GUIDE AND IMAGE RECORDING APPARATUS

(71) Applicant: Yuta Uchino, Nagoya (JP)

(72) Inventor: Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/769,187

(22) Filed: Feb. 15, 2013

(65) Prior Publication Data

US 2013/0154183 A1 Jun. 20, 2013

Related U.S. Application Data

(62) Division of application No. 13/073,827, filed on Mar. 28, 2011, now Pat. No. 8,398,074.

(30) Foreign Application Priority Data

Jun. 17, 2010 (JP) ..... 2010-138668

(51) Int. Cl.
*B65H 1/00* (2006.01)

(52) U.S. Cl.
USPC ..... 271/171

(58) Field of Classification Search
USPC ..... 271/171; 399/393
See application file for complete search history.

(56) References Cited

U.S. PATENT DOCUMENTS

| | | | |
|---|---|---|---|
| 5,988,621 | A | 11/1999 | Kondo et al. |
| 2007/0183832 | A1 | 8/2007 | Asada et al. |
| 2008/0292382 | A1 | 11/2008 | Asada et al. |

FOREIGN PATENT DOCUMENTS

| | | | |
|---|---|---|---|
| JP | H07-054193 | Y2 | 3/1991 |
| JP | H09-136728 | A | 5/1997 |
| JP | H11-059922 | A | 3/1999 |
| JP | 2000-177850 | A | 6/2000 |
| JP | 2007-176694 | A | 7/2007 |
| JP | 2008-290852 | A | 12/2008 |
| JP | 4396727 | B2 | 12/2008 |

OTHER PUBLICATIONS

Japan Patent Office, Notice of Reasons for Rejection for Japanese Patent Application No. 2010-138668 (counterpart to co-pending U.S. Appl. No. 13/073,827), mailed May 1, 2012.

Japan Patent Office, Decision to Grant a Patent for Japanese Patent Application No. 2010-138668 (counterpart to co-pending U.S. Appl. No. 13/073,827), mailed Aug. 28, 2012.

*Primary Examiner* — Michael McCullough
(74) *Attorney, Agent, or Firm* — Baker Botts L.L.P.

(57) ABSTRACT

A sheet guide includes a base on which a sheet is placed; a pinion which is rotatably provided on the base; a pair of racks which are extended in a sliding direction, which sandwich the pinion therebetween, which are engaged with the pinion to move opposite to each other in the sliding direction; a pair of positioning members which are provided at one end portions of the pair of racks respectively; a sliding guide which is formed in the base and which guides the pair of racks in the sliding direction; and a contact portion which is provided at a side of at least one rack of the racks; a first supporting member configured to press the contact portion to urge the at least one rack against the pinion; and a second supporting member configured to support the other end portion of the at least one rack.

6 Claims, 11 Drawing Sheets

SHEET GUIDE AND IMAGE RECORDING APPARATUS

CROSS REFERENCE TO RELATED APPLICATION

The present application is a Divisional application of U.S. patent application Ser. No. 13/073,827 filed on Mar. 28, 2011, claiming priority from Japanese Patent Application No. 2010-138668, filed on Jun. 17, 2010, the disclosure of which is incorporated herein by reference in its entirety.

BACKGROUND OF THE INVENTION

1. Field of the Invention

The present invention relates to a sheet guide and an image recording apparatus. For instance, at the time of transporting a sheet such as a recording paper, there is a structure of a sheet guide which positions the sheet in a direction intersecting a transporting direction. Such sheet guide is typically used in an automatic document feeder installed in an image recording apparatus, and other document trays and a paper feeding tray which supports the recording paper.

2. Description of the Related Art

An image recording apparatus such as a copy machine and a printer includes a tray on which a plurality of sheets (basically, documents and recording papers) is piled up. Sheets placed on the tray, upon being separated one-by-one, are dispatched in a predetermined direction of transporting, and an image processing such as an image reading and an image recording is carried thereon. For a favorable image processing to be carried out, a sheet is to be prevented from being passed obliquely when transported. For this, the tray has hitherto been provided with a sheet guide.

The sheet guide includes a guide which guides the sheet along the transporting direction. The guide has a pair of guide surfaces along the transporting direction, and the sheet is positioned along the guide surfaces. There are two types of methods (modes) for positioning the sheet. These two methods are so-called side-register type and a center-register type. In the side-register type, one of the guide surfaces is fixed, and one side of the sheet makes a contact with the fixed guide surface. In a state of one side of the sheet making a contact with one guide surface, the other guide surface comes closer or moves away from the fixed guide surface, and makes a contact with the other side of the sheet. Accordingly, the sheet is positioned with the fixed guide surface as a base (reference position). Moreover, in the center-register type, guide surfaces in pair come closer or move away mutually, and the two guide surfaces make a contact with the two sides of the sheet. Accordingly, the two sides of the sheet are sandwiched between the two guide surfaces, and the sheet is positioned with a center of the two guide surfaces as a base. A conventional mechanism for bringing closer or moving away a pair of side guides is a rack and pinion mechanism.

In both the types, since a prompt positioning of a sheet is realized, it is sought that the guide surfaces in pair come closer or move away easily according to the sheet which is to be transported. On the other hand, for a favorable image processing to be carried out on the plurality of sheets, the movement of the guide surfaces has to be regulated during continuous transporting of the sheets. Particularly, in the center-register type provided with the rack and pinion mechanism, since the guide surfaces in pair are susceptible to come closer and move away relatively, regulation of the movement of the guide surfaces has been sought strongly. Therefore, in the sheet guide which has hitherto been used, a sliding washer has been provided to a pinion. Accordingly, a sliding resisting power (sliding resistance) is generated (developed) when the pinion rotates, and the guide surfaces in pair have been regulated to move easily.

SUMMARY OF THE INVENTION

Generally, the sliding washer is fastened by a screw together with the pinion. However, by providing such sliding washer, a dimension of the sheet guide (a dimension in a direction of thickness of the pinion) increases, and as a result, leads to an increase in a size of the image recording apparatus in which the sheet guide is installed.

Moreover, when the sliding washer is to be added, structurally, a stable sliding resistance is hardly exerted. Therefore, when there is an extreme increase or decrease in the sliding resistance, there is a problem of having a difficulty in carrying out positioning of a sheet. Though, a stable sliding resistance may be exerted when a mechanism for adjusting a joining force to the sliding washer is provided separately. However, when such a mechanism is provided, it will lead to further increase in size and cost of the image recording apparatus.

In view of the abovementioned circumstances, an object of the present teaching is to provide a sheet guide having a simple structure, which is capable of positioning a sheet by a center-register type, and maintaining a state in which the sheet is positioned.

According to a first aspect of the present teaching, there is provided a sheet guide configured to guide a sheet in a predetermined direction, including: a base on which the sheet is placed; a pinion which is rotatably provided on the base; a pair of racks which are extended in a sliding direction perpendicular to the predetermined direction, which face each other sandwiching the pinion therebetween, which are engaged with the pinion to move opposite to each other in the sliding direction by a rotation of the pinion, which have one end portion and the other end portion in the sliding direction respectively, and the pinion being provided between one end portion and the other end portion; a pair of positioning members which are provided at one end portions of the pair of racks respectively, and which come closer and move away from each other by movement of the pair of racks to position the sheet in the sliding direction; a sliding guide which is formed in the base, which is slidably engaged with one end portion of each of the pair of racks to guide the pair of racks in the sliding direction; a contact portion which is provided at a side of at least one rack of the racks opposite to a side engaged with the pinion, and which is protruded at a portion of the at least one rack, the portion being located between one end portion of the at least one rack and an engage site of the at least one rack engaging with the pinion; a first supporting member which is provided on the base and which is configured to press the contact portion to urge the at least one rack against the pinion; and a second supporting member which is provided on the base and which is configured to support the other end portion of the at least one rack from a side of the at least one rack opposite to a side at which the contact portion is provided, the pinion being provided between the second supporting member and the positioning member provided at one end portion of the at least one rack in the sliding direction.

According to a second aspect of the present teaching, there is provided an image recording apparatus which records an image on a sheet, including: an image recording section which records an image on the sheet which is transported along a transporting path which has been formed in the image recording apparatus; and a sheet guide according to the first aspect, of which a base is connected to the transporting path and which guides the sheet to the transporting path.

According to the aspects of the present teaching, since a sliding resistance of the rack is substantially constant, when a user attempts to bring closer the positioning members in pair intentionally, by applying an external force countering the sliding resistance, it is possible to bring the positioning members in pair closer by sliding stably. Similarly, when the user attempts to move away (apart) the positioning members in pair intentionally, by applying an external force countering the sliding resistance, it is possible to move the positioning members in pair away by sliding stably. Consequently, even when the sheets are to be transported continuously, assured positioning of each sheet is achieved. Besides, since the sliding resistance is caused by a frictional force based on a supporting-point reactive force (reaction) which is developed at a site at which the rack and the pinion are engaged, a mechanism for generating the sliding resistance is extremely simple.

BRIEF DESCRIPTION OF THE DRAWINGS

FIG. 4A shows a front surface on which the sheet is placed, and FIG. 4B shows a rear surface;

DETAILED DESCRIPTION OF THE PREFERRED EMBODIMENTS

Exemplary embodiments of the present teaching will be described below while referring to the accompanying diagrams. However, the embodiments described below are some of the embodiments of the present teaching, and it is needless to mention that the embodiments described below may be modified such that the modifications fairly fall within the basic teaching herein set forth.

First Embodiment

Outline of Copy Machine

Figure 1:
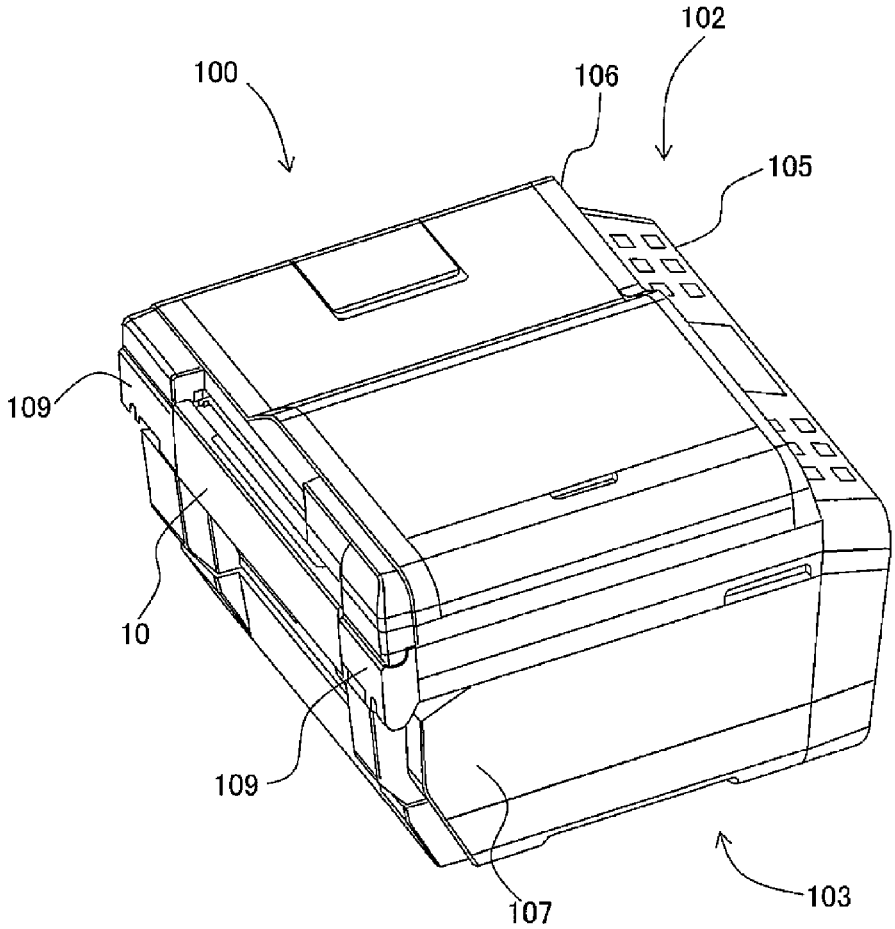
FIG. 1 is an external perspective view of a copy machine (multi-function device) 100 according to a first embodiment.
Figure 2:
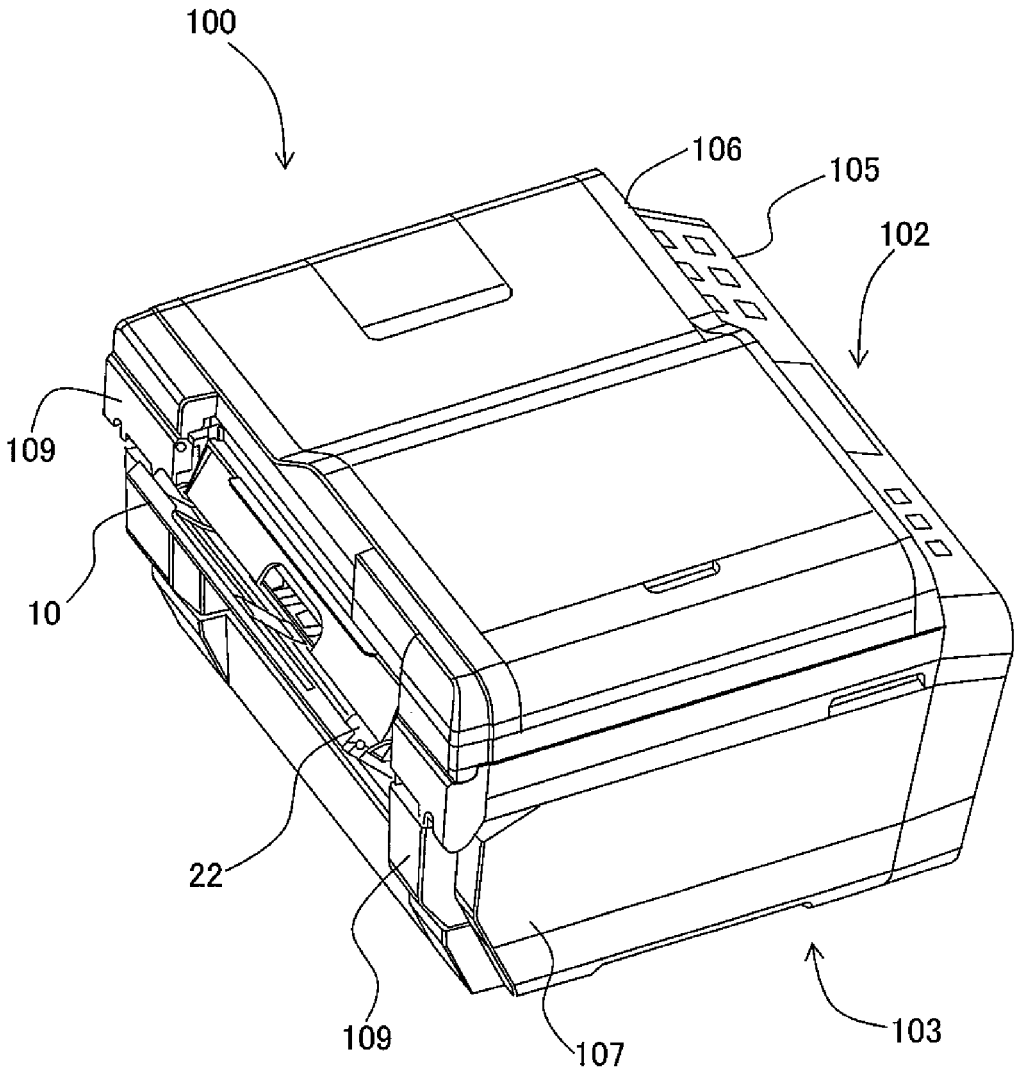
FIG. 2 is an external perspective view of the copy machine according to the first embodiment.

As shown in FIG. 1 and FIG. 2, a copy machine 100 includes an image reading section 102 at an upper portion, and a printer section 103 (corresponds to 'an image recording apparatus' of the first embodiment) of an ink-jet recording type at a lower portion. The copy machine 100 has various functions such as a facsimile function, a printer function, a scanner function, and a copy function. A transporting path 101, which will be described later, is formed in the printer section 103, and a sheet (typically a recording paper) is transported along the transporting path 101. A recording section 112 (refer to FIG. 3) is arranged in the transporting path 101, and the recording section 112 records an image on the sheet which is transported along the transporting path 101. A peculiarity (characteristic) of the first embodiment is a point that a sheet guide 10 which will be described later is provided at an upstream side of the transporting path 101. The sheet guide 10 will be described later in detail.

[Structure of Image Reading Section]

The image reading section 102 is installed at an upper portion of the printer section 103. The image reading section 102 includes an operation panel 105 and a scanner section 106. The operation panel 105 includes various operation buttons and a liquid-crystal display section, and the copy machine 100 is operated by an input from the operation panel 105. In the first embodiment, the scanner section 106 includes a flat bed scanner (FBS) and an automatic document feeder (ADF)

[Structure of the Printer Section]

The printer section 103 includes a casing 107, and various components of the printer section 103 are installed in the casing 107. An opening (not shown in the diagram) is provided in a front surface of the printer section 103, and through the opening, an accommodating chamber is formed (demarcated) at an interior of the casing 107. A paper feeding cassette 108 (refer to FIG. 3) is installed in the accommodating chamber. An opening 110 is provided in a rear surface 109 of the printer section 103. The opening 110 communicates with the transporting path 101. Moreover, the sheet guide 10 is installed in the opening 110. The sheet guide 10 is rotatably provided to the casing 107 to open and close the opening 110 (refer to FIG. 2).

Figure 3:
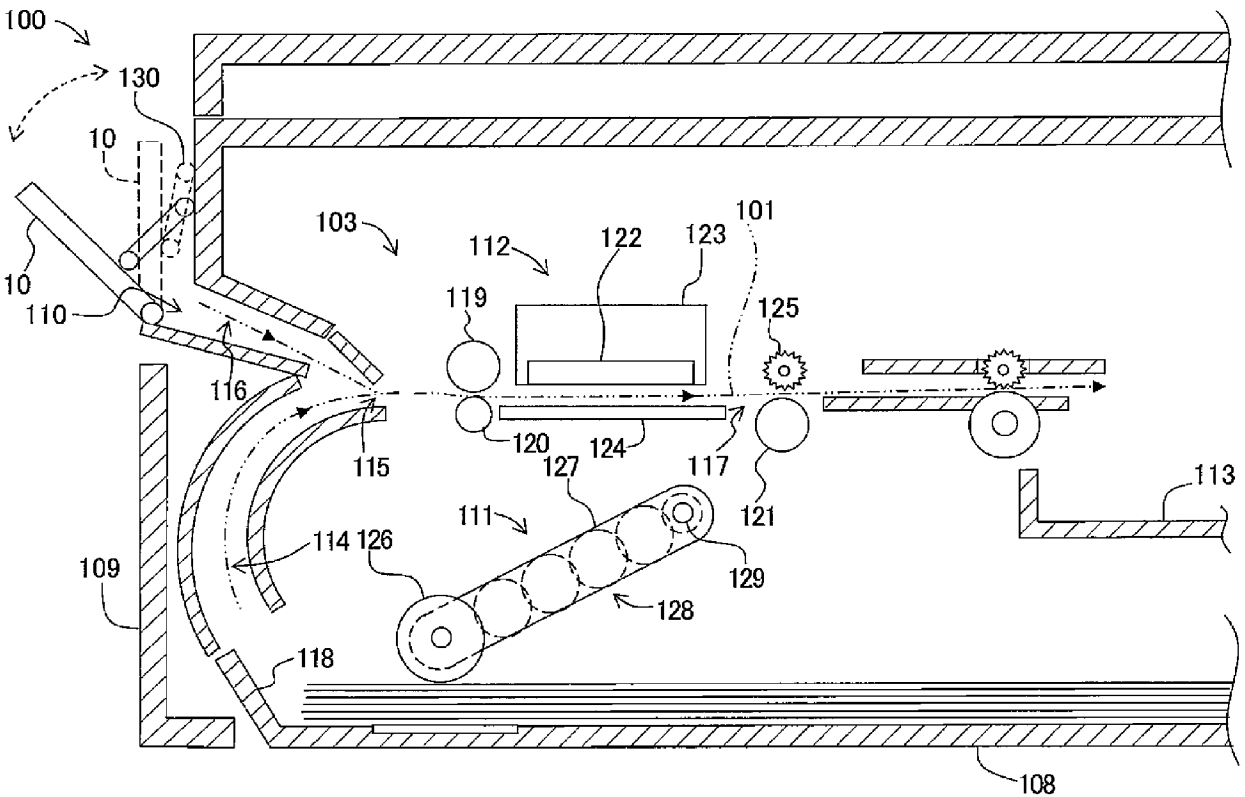
FIG. 3 is a schematic diagram showing an internal structure of a printer section 103.

As shown in FIG. 3, the transporting path 101 is formed at the interior of the printer section 103. The printer section 103 includes a feeding section 111 which picks up and dispatches a sheet from the paper feeding cassette 108 toward a left side in the diagram, and the recording section 112 of an ink-jet recording type which records an image by jetting ink droplets on to the sheet. An image is recorded by the recording section 112 on the sheet which has been transported by the feeding section 111 to the transporting path 101, while the sheet is being transported in a transporting direction (a direction of arrows on two-dot chain lines) along the transporting path 101.

[Transporting Path and Transporting Roller]

The transporting path 101 is formed to be extended from the paper feeding cassette 108 and the sheet guide 10 reaching up to a discharge-paper holding portion 113. The transporting path 101 includes a feeding path 114 which is in a bent form, and is extended from a front end of the paper feeding cassette 108 up to the recording section 112, a merging path 116 which is extended from a front end of the sheet guide 10 up to a merging point 115 of the feeding path 114, and a recording guiding path 117 which is extended from the merging point 115 up to the discharge-paper holding portion 113 via the recording section 112.

Since the feeding path 114 is bent as mentioned above, a sheet which has been transported from the paper feeding cassette 108 enters the recording guiding path 117 upon making a U-turn via a separating (separated) inclined plate 118. The merging path 116 guides the sheet which has been supplied from the sheet guide 10 to the recording guiding path 117 via the merging point 115. The sheet which has entered the recording guiding path 117 is nipped by a first transporting roller 119 and a pinch roller 120, and is sent in the transporting direction. The recording section 112 and a second transporting roller 121 are arranged along the recording guiding path 117. An image is recorded by the recording section 112 on the sheet which is sent in the transporting direction. The recording section 112 includes a carriage 123 on which a recording head 122 is mounted and a platen 124 which is arranged face-to-face with the carriage 123, sandwiching the recording guiding path 117. The sheet is sent on the platen 123. A desired image is recorded on the sheet by ink droplets from the recording head 122 being jetted on to the sheet, while the carriage 123 slides in a direction parallel to a paper surface. The second transporting roller 121 forms a pair with a spur 125 and the sheet is pinched by the second transporting roller 121 and the spur 125, and is sent further in the transporting direction.

[Feeding Section]

The feeding section 111 is a section which feeds sheets accommodated in the paper feeding cassette 108 toward the feeding path 114, and includes a paper feeding roller 126, a paper feeding arm 127, and a drive transmitting mechanism 128. The paper feeding roller 126 is arranged at an upper side of the paper feeding cassette 108. The paper feeding roller 126 is rotatably pivoted at a front end of the paper feeding arm 127, and picks up a sheet accommodated in the paper feeding cassette 108 and feeds to the feeding path 114. A base end portion of the paper feeding arm 127 is connected to the casing 107 via a pivot (base shaft) 129, and is pivoted vertically with the pivot 129 as a center. Accordingly, the paper feeding roller 126 is capable of making a pressed contact with an upper surface of sheets accommodated in the paper feeding cassette 108. The paper feeding roller 126 is rotated by a rotational force of a paper feeding motor, which is not shown in the diagram, being transmitted via the drive transmitting mechanism 128. The drive transmitting mechanism 128 includes a gear row provided to the paper feeding arm 127.

[Outline of Sheet Guide]

As shown in FIG. 4, the sheet guide 10 is typically used in a paper feeding tray of an image recording apparatus, and supports and positions a recording paper and other sheets as a recording medium. For an image to be recorded thereon, the sheet is fed along a predetermined transporting direction 13, and an image is recorded by an image recording section (not shown in the diagram) which is arranged at a downstream side of the transporting direction 13. The sheet guide 10, for transporting the sheets, positions and aligns a plurality of sheets in a direction 14 orthogonal to the transporting direction 13.

The sheet guide 10 includes a pair of positioning plates (an example of 'positioning members' in the first embodiment) 11 and 12. The positioning plates 11 and 12 slide along the direction 14 via a rack and pinion mechanism 15 which will be described later in detail. In other words, the sheet guide 10 according to the first embodiment is of a so-called center-register type. In the present patent specification, the direction 14 is called as a 'sliding direction 14'.

Plurality of sheets which are not shown in the diagram is aligned to be sandwiched between the positioning plates 11 and 12, and is positioned with a center of each sheet coinciding with a center of the sheet guide 10. A peculiarity (characteristic) of the first embodiment is a structure of the rack and pinion mechanism 15. By the rack and pinion mechanism 15 having a structure which will be described later, it is possible to position each sheet by sliding the positioning plates 11 and 12 easily, and furthermore, a state with the sheets positioned is maintained.

[Structure of Sheet Guide]

The sheet guide 10 includes a base 16, the positioning plates 11 and 12, a pinion 17 which is arranged on the base 16, and a pair of racks 18 and 19 which are engaged with the pinion 17. The positioning plates 11 and 12 are connected to the pair of racks 18 and 19 respectively.

As shown in FIG. 4A, FIG. 4B, FIG. 5A, and FIG. 5B, the base 16 is in the form of a long and thin rectangular plate. A fitting pin 20 is protruded from each side surfaces of the base 16. The fitting pins 20 are engaged with the casing 107 of the copy machine 100, and accordingly, the sheet guide 10 is installed in the casing 107. The base 16 includes a main plate 21 and a plurality of reinforcing ribs 22. The base 16 is connected to an upstream side of the merging path 116 (refer to FIG. 3). In the first embodiment, the base 16 is made of a resin (material), and the main plate 21 and the reinforcing ribs 22 are formed integrally. The reinforcing ribs 22 are arranged on an edge surface of the main plate 21 to improve a stiffness (rigidity) of the main plate 21, and are erected at a desired site. In the first embodiment, since the sheet guide 10 is to be used in a paper feeding tray of an image forming apparatus, the reinforcing ribs 22 are formed to be complicated. It is preferable that the reinforcing ribs 22 are capable of securing a desired stiffness (rigidity) of the main plate 21.

Figure 4A:
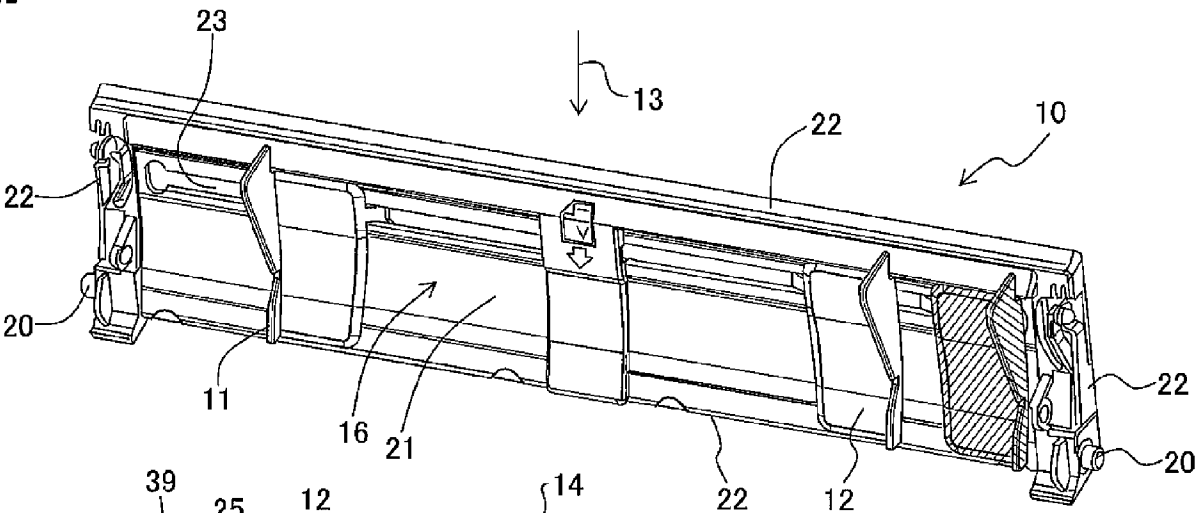
FIG. 4A and FIG. 4B are external perspective views of a sheet guide 10 according to the first embodiment.

Particularly as shown in FIG. 4A, two guide grooves 23 (an example of a 'sliding guide' in the first embodiment) are formed in the main plate 21. The guide grooves 23 are extended along the sliding direction 14. In the first embodiment, the two guide grooves 23 are arranged symmetrically along the sliding direction 13 with a center of the main plate 21 as a base (reference position). The racks 18 and 19 are fitted in the guide grooves 23, and slide along the sliding direction upon being guided by the guide grooves 23. In other words, one-end portion 39 of the rack 18 is fitted in one guide groove 23, and one end portion of the rack 19 is fitted in the other guide groove 23. The racks 18 and 19 are capable of moving only in the sliding direction 14, and are restricted from being displaced in a direction other than the sliding direction 14. Consequently, the racks 18 and 19 slide in the sliding direction, while in a state of facing mutually.

The pinion 17 is arranged at a central portion of the main plate 21, or in other words, at a boundary portion of the pair of guide grooves 23. A supporting shaft 24 is arranged at the boundary portion of the pair of guide grooves 23. The supporting shaft 24 is erected on the main plate 21, and the pinion 17 is rotatable upon being supported by the supporting shaft 24. As it will be described later in detail, the rack and pinion mechanism 15 is formed by the racks 18 and 19 being engaged with the pinion 17.

Figure 4B:
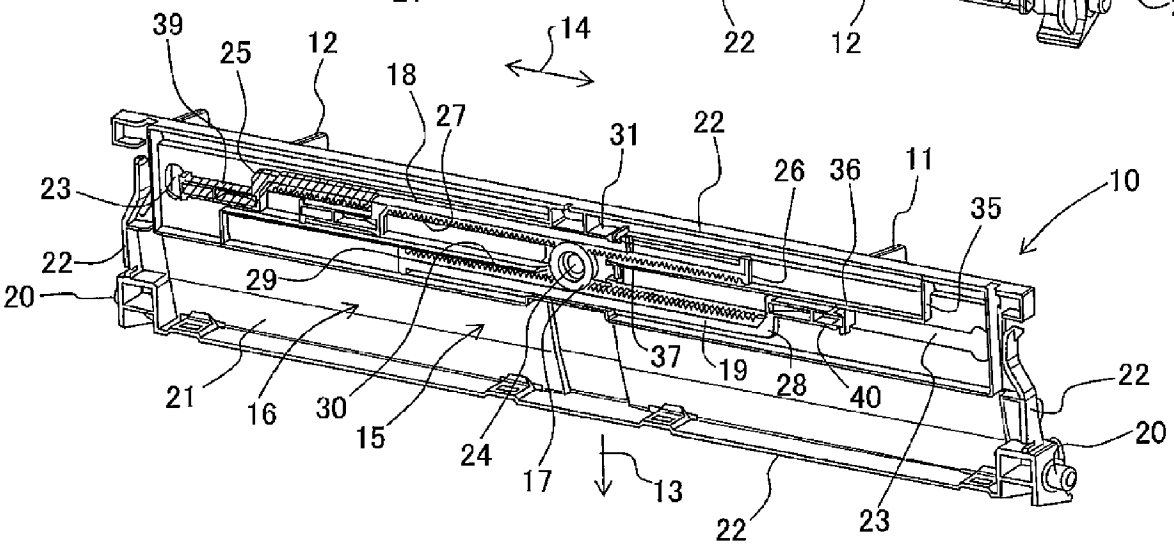
Figure 5A:
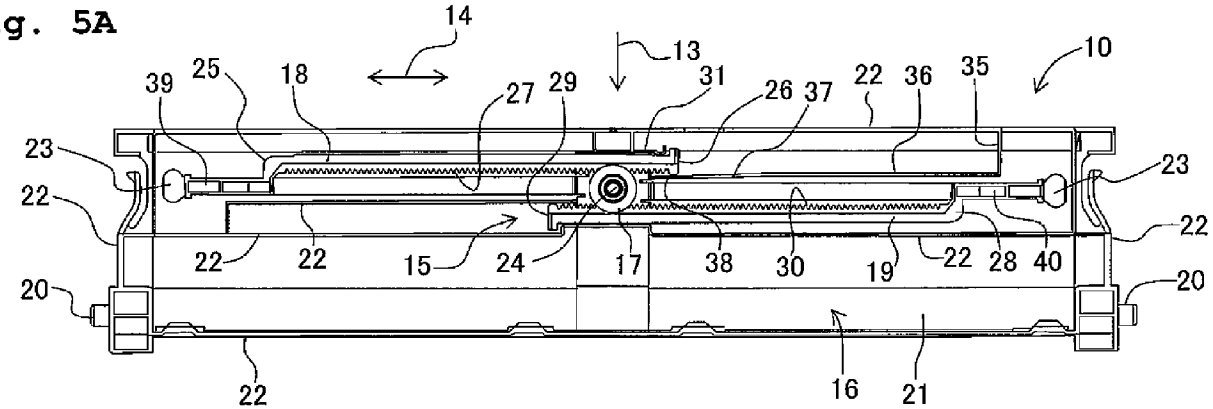
FIG. 5A and FIG. 5B are front views of the sheet guide 10.
Figure 5B:
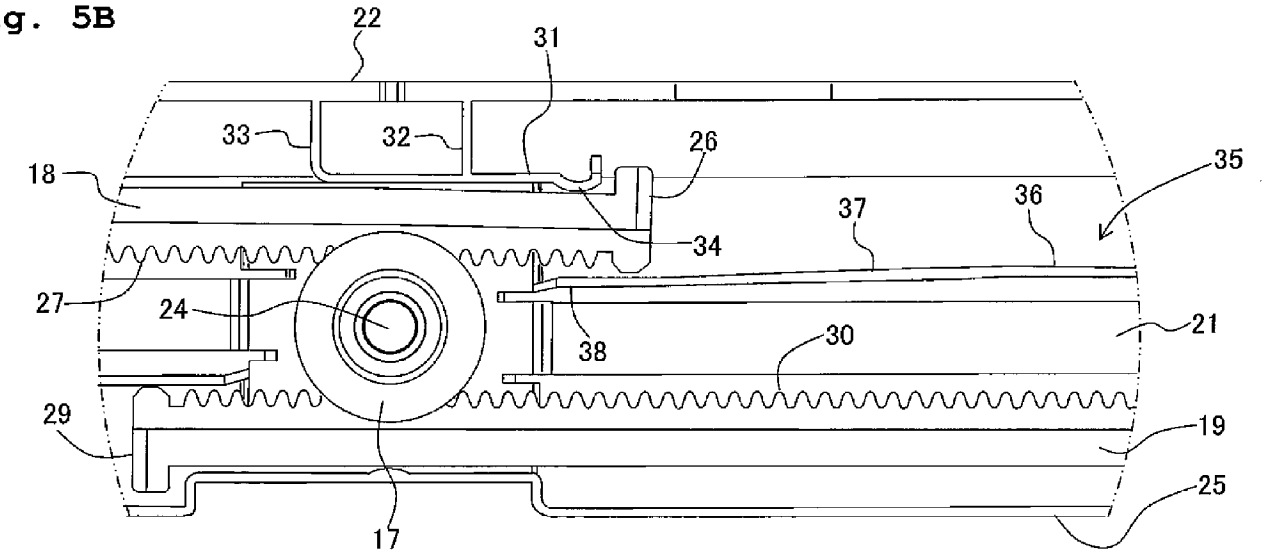

The rack 18 is a member in the form of a long and slender rod, and is formed to be crank-shaped. In other words, as shown in FIG. 4B, FIG. 5A, and FIG. 5B, an intermediate portion 25 of the rack 18 is bent. An area from one end of the rack 18 up to the intermediate portion 25 (a one end portion 39 of the rack 18) is fitted into the guide groove 23. Moreover, the positioning plate 12 is provided at the one end portion 39 of the rack. Furthermore, teeth 27 which are to be engaged with the pinion 17 are formed in an area of the rack 18, from the intermediate portion 25 up to the other end portion 26. The rack 18 and the positioning plate 12 are formed integrally, of a resin (material).

The rack 19 is formed to be bilaterally symmetrical with the rack 18. In other words, the rack 19 is also formed to be crank-shaped, and an intermediate portion 28 is bent. An area from one end of the rack 19 up to the intermediate portion 28 (a one end portion 40 of the rack 19) is fitted into the guide groove 23. The positioning plate 11 is provided at the one end portion 40 of the rack 19. Teeth 30 are formed in an area of the rack 19, from the intermediate portion 28 up to the other end portion 29, and these teeth 30 are engaged with the pinion 17. The positioning plate 11 is formed integrally with the rack 19, of a resin (material). By the racks 18 and 19 being arranged face-to-face sandwiching the pinion 17 in such manner, the rack and pinion mechanism 15 is formed, and by the racks 18 and 19 sliding along the sliding direction 14, the positioning plate 11 and 12 come closer or move away.

As shown in FIG. 5A and FIG. 5B, a pressing arm (pushing arm) 31 is (an example of a 'pressing member' in the first embodiment) provided to a reinforcing rib 22 which is arranged at an upstream side in the transporting direction 13 of a main plate 20. The pressing arm 31 is formed integrally with the reinforcing rib 22. As shown in FIG. 5B, the pressing arm 31 is in the form of a long and slender belt extended along the sliding direction 14. The pressing arm 31 is fixed to the reinforcing rib 22 via a pair of connecting legs 32 and 33. A projection 34 is formed at a front-end portion of the pressing arm 31. The projection 34 is protruded toward a downstream side in the transporting direction 13 as shown in FIG. 5B, and presses (pushes) the rack 18, in the transporting direction 13, to urge the rack 18 against the pinion 17. Consequently, the rack 18 is pressed toward the pinion 17 by the projection 34. In other words, the rack 18 is supported in an opposite direction of the transporting direction 13 by the pinion 17, and furthermore, a site toward the other end portion 26 farther than the supporting point (a site engaged with the pinion 17) is pressed in the transporting direction 13 by the projection 34. Accordingly, the rack 18 is subjected to a bending moment, and is deformed elastically toward a downstream side of the transporting direction 13.

Moreover, a supporting plate (an example of a 'supporting member' in the first embodiment) 35 is erected on the main plate 21. The supporting plate 35, as shown in FIG. 5A, is a member in the form of a plate which is bent to be L-shaped, and is connected to the reinforcing rib 22 which is arranged at the upstream side of the transporting direction 13. The supporting plate 35 includes a supporting surface 36. The supporting surface 36 is an upper surface (a surface at the upstream side of the transporting direction 13) of the supporting plate 35, and is extended along the sliding direction 14. In this embodiment, as shown in FIG. 5B, the supporting plate 35 is extended toward the pinion 17 to face the pressing arm 31 and a part of the rack 18 is between the supporting plate 35 and the pressing arm 31. Consequently, the rack 18 is pushed by the pressing arm 31 and is deformed toward the downstream side of the transporting direction 13, and in that case, the other end portion 26 of the rack 18 makes a contact with the supporting surface 36, and is supported by the supporting plate 35 in the opposite direction of the transporting direction 13. In other words, the supporting plate 35 supports the other end portion 26 from a side of the rack 18 opposite to a side pressed by the pressing arm 31. When the rack 18 has moved in the sliding direction 14 by the rack and pinion mechanism 15, the other end portion 26 of the rack 18 slides in the sliding direction 14 on the supporting surface 36.

Furthermore, as shown in FIG. 5B, in the first embodiment, an area 37 of the supporting surface 36, near the pinion 17 is inclined. Concretely, the area 37 is inclined with respect to the sliding direction such that, the area 37 comes closer to the rack 18 as moving away from the pinion 17. In other words, the area 37 of the supporting surface 36, as moving away from the pinion 17, is inclined toward a direction opposite to a pressing direction in which, the pressing arm 31 presses (pushes) the rack 18. Moreover, the area 37 of the supporting surface 36, as coming closer to the pinion 17, is inclined toward the pressing direction with respect to the sliding direction 14. Therefore, as shown in FIG. 5B, the racks 18 and 19 slide, and when a distance between the positioning plates 11 and 12 has become substantial (in other words, when the other end portion 26 of the rack 18 has come close to the pinion 17), the other end portion 26 of the rack tends to move away relatively from the supporting surface 36. An action and an effect of the supporting plate 36, and an action and an effect due to a part of the supporting surface 36 being inclined will be described later.

[Procedure for Sheet Alignment]

Sheets are aligned and positioned on the sheet guide 10 in the following manner. A user operates the positioning plates 11 and 12 and draws apart mutually. Since the positioning plates 11 and 12 are arranged face-to-face via the rack and pinion mechanism 15, by the user holding at least one of the positioning plates 11 and 12, and sliding in the sliding direction 14, the positioning plates 11 and 12 come closer and are separated apart (oblique line) as shown in FIG. 4A. When a plurality of sheets is placed on the main plate 21, by the positioning plates 11 and 12 coming closer, both edges of the sheets in the sliding direction 14 make a contact with the positioning plates 11 and 12, and the sheets are positioned at the center.

Figure 6A:
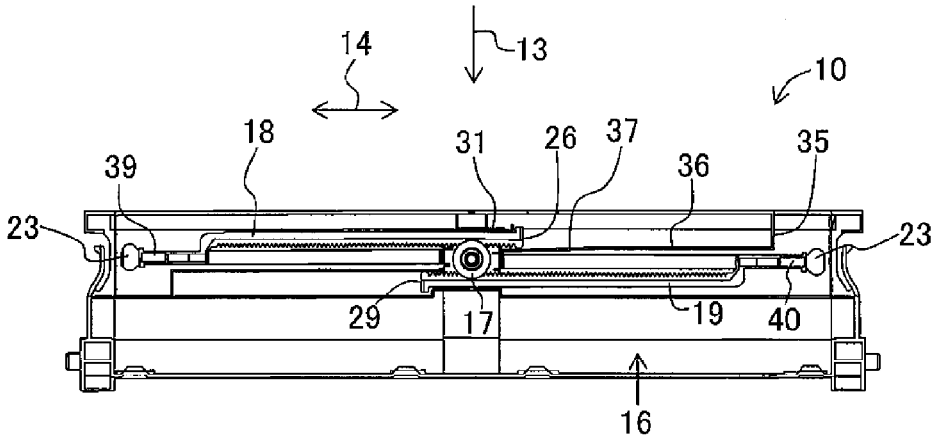
FIG. 6A, FIG. 6B, and FIG. 6C are front views of the sheet guide 10.
Figure 6B:
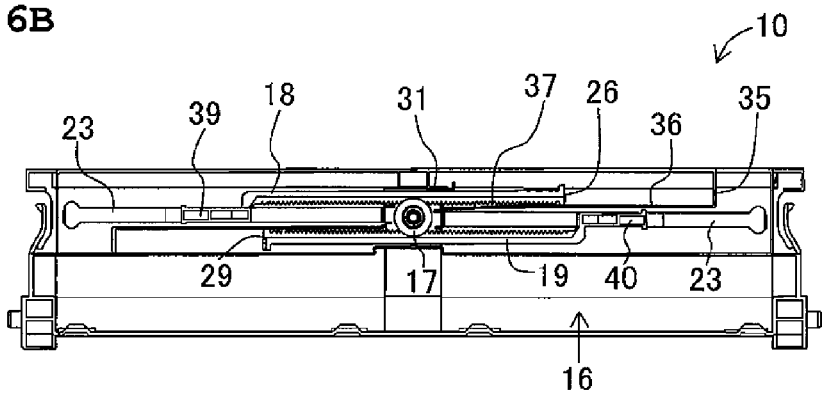
Figure 6C:
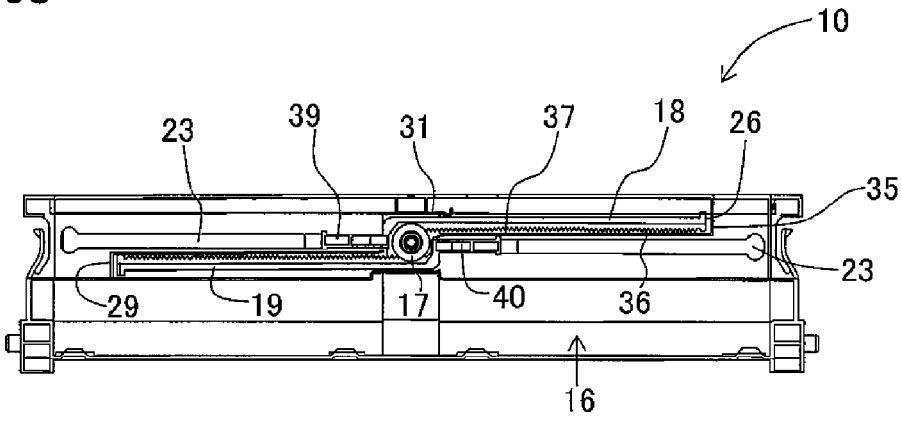

As shown in FIG. 6A, FIG. 6B, and FIG. 6C (hereinafter, 'FIG. 6A to FIG. 6C') when the racks 18 and 19 slide along the sliding direction 14, the one end portions 39 and 40 of the racks 18 and 19 respectively are guided to the guide groove 23. Consequently, the user is able to carry out smoothly, a sliding movement of the racks 18 and 19, or in other words, the operation of bringing closer and moving away (apart) the positioning plates 11 and 12. Besides, the rack 18 is subjected to a thrust by the pressing arm 31 as described above, and is pressed against the pinion 17. In other words, the rack 18, with a site of engagement with the pinion 17 (a site at which the rack 18 is supported by the pinion 17) as a supporting point, is subjected to the thrust at a position separated apart from the supporting point. Consequently, a bending moment acts on the rack 18, and a supporting-point reactive force is developed (generated). Due to the supporting-point reactive force, a frictional force is generated between the rack 18 and the pinion 17, and the frictional force becomes a sliding resistance of the rack 18. As a result, the positioning plates 11 and 12 which have positioned the sheets are restricted from sliding easily, and a state in which the sheets are positioned is maintained. In the first embodiment, the thrust is exerted only to the rack 18. However, an arrangement may be made such that the thrust is exerted similarly to the rack 19 also.

As the rack 18 is pressed as described above with the pinion 17 as a supporting point, when an amount of deformation of the rack 18 has become substantial, there is a possibility that the rack 18 and rack 19 come in contact. In the first embodiment, since the supporting plate 35 is provided, even when the rack 18 is deformed substantially, the rack 18 makes a contact with the supporting plate 35, and slides making a sliding contact with the supporting surface 36. Consequently, a collision of the racks 18 and 19 is avoided, and damage to the racks 18 and 19 is prevented.

For instance, as shown in FIG. 6B, when the rack 18 has made a contact with the supporting surface 36, a supporting point is developed at a site of contact of the other end portion 26 of the rack 18 and the supporting plate 35, and a predetermined supporting-point reactive force Rb is generated at the other end portion 26 of the rack 18. Consequently, forces which are exerted on the rack 18 are, a supporting-point reactive force Ra at a site supported by the pinion 17, the supporting-point reactive force Rb of the other end portion 26, and a thrust P exerted by the pressing arm 31. Moreover, by the rack 18 moving in the sliding direction 14, a span S1 between a position at which, the thrust P is exerted and a position at which, the supporting-point reactive force Rb is exerted changes. Here, when the span S1 is small (short), or in other words, when the one end portions 39 and 40 of the racks 18 and 19 respectively are separated apart, and the distance between the positioning plates 11 and 12 has increased (has become longer), the supporting-point reactive force becomes extremely substantial (increases extremely), and there is a possibility that the smooth sliding of the racks 18 and 19 becomes difficult.

Incidentally, as the supporting surface 36 of the supporting plate 35 is inclined, as mentioned above, when the other end portion 26 of the rack 18 slides from a state shown in FIG. 6B to a state shown in FIG. 6A, and enters the area 37, the other end portion 26 of the rack 18 tends to be separated apart (move away) relatively from the supporting surface 36. In other words, a force by which the other end portion 26 of the rack 18 is pressed against the supporting surface 36 is relaxed (reduced), and the supporting-point reactive force Rb is reduced. In the first embodiment, as shown in FIG. 5B, an angle of inclination of the supporting surface 36 is set to be such that when the other end portion 26 of the rack 18 has come closer to the pinion 17, a distance between the other end portion 26 and the supporting plate 35 increases. However, the other end portion 26 of the rack 18 is not necessarily required to be separated apart from the supporting surface 36, and the angle of inclination of the supporting surface 36 may be set to be such that the other end portion 26 of the rack 18 is in contact with the supporting plate 35 all the time. In this manner, in the first embodiment, the force by which the other end portion 26 of the rack 18 is pushed by the supporting surface 36 is reduced (relaxed), and the supporting-point reactive force Rb is avoided from becoming extremely substantially. Accordingly, coming closer and moving away smoothly of the positioning plates 11 and 12 is realized, while the collision of the racks 18 and 19 is avoided.

As it has been described above, according to the structure of the first embodiment, a sheet is placed on the base 16 in a state of being arranged between the pair of positioning plates 11 and 12. The pair of positioning plates 11 and 12 slides to come closer and move away relatively with the pinion 17 as a center, via the rack and pinion mechanism 15 which is formed by the pinion 17 and the pair of racks 18 and 19. Since the pair of positioning plates 11 and 12 is provided at one end portions of the pair of racks 18 and 19 respectively, the pair of racks 18 and 19 come closer or move away (are separated apart) by being slid. Accordingly, the positioning plates 11 and 12 sandwich the sheet, and by making a contact with both edges in the sliding direction, of the sheet, the sheet is positioned in the sliding direction.

When the racks 18 and 19 slide, one end portions of the racks 18 and 19 are guided by the sliding guide grooves 23. Accordingly, a sliding movement of the pair of racks 18 and 19, or in other words, movement of coming closer and moving away along the sliding direction of the positioning plates 11 and 12 in pair becomes smooth. Besides, at least one of the racks is subjected to the thrust from the pressing arm 31. Concretely, the racks 18 and 19 are subjected to a force pressing toward the pinion 17, at a site toward the other end portion 26 farther than the pinion 17, with the site supported by the pinion as a supporting point. Consequently, a bending moment acts on the rack, and a supporting-point reactive force is generated at the site of engagement with the pinion 17. Due to the supporting-point reactive force, a frictional force is generated between the rack and the pinion, and the frictional force becomes a sliding resistance (resistance against sliding) of the rack. Besides, since a distance between the pinion and the pressing member is constant all the time, the frictional force also becomes substantially constant all the time.

In this manner, when the rack 18 is pushed with the pinion 17 as a supporting point, the rack 18 undergoes elastic deformation. An amount of deformation is determined by the bending moment and a modulus of section (a section modulus) of the rack 18, and depending on the amount of deformation, there is a possibility that the rack 18 makes a contact with the other rack 19. However, in the first embodiment, since the supporting plate 35 is provided, even when the amount of deformation becomes substantial, the rack 18 makes a contact with the supporting surface 36, and the collision of the racks is avoided.

Incidentally, in a case in which, the rack 18 has made a contact with the supporting surface 36, a supporting point is developed at a site of contact of the rack 18 and the supporting plate 35, and a predetermined supporting-point reactive force is generated. In other words, the rack 18 is subjected to a supporting-point reactive force Ra at the supporting point, a supporting-point reactive force Rb at the site of contact with the supporting plate 35, and the thrust P by the pressing arm 31. Besides, the span S1 between the position at which, the thrust P is exerted and the position at which, the supporting-point reactive force Rb is exerted, changes with the sliding of the rack. Therefore, when the span S1 has become small, the supporting-point reactive force Rb becomes extremely substantial, and there is a possibility that the smooth sliding of the rack becomes difficult. However, since the area of the supporting surface 36, near the pinion is inclined as mentioned above, the supporting-point reactive force is avoided from becoming extremely substantial. Consequently, coming closer and moving away smoothly of the positioning members in pair is realized, while the collision of the racks is avoided.

First Modified Embodiment of First Embodiment

Figure 7A:
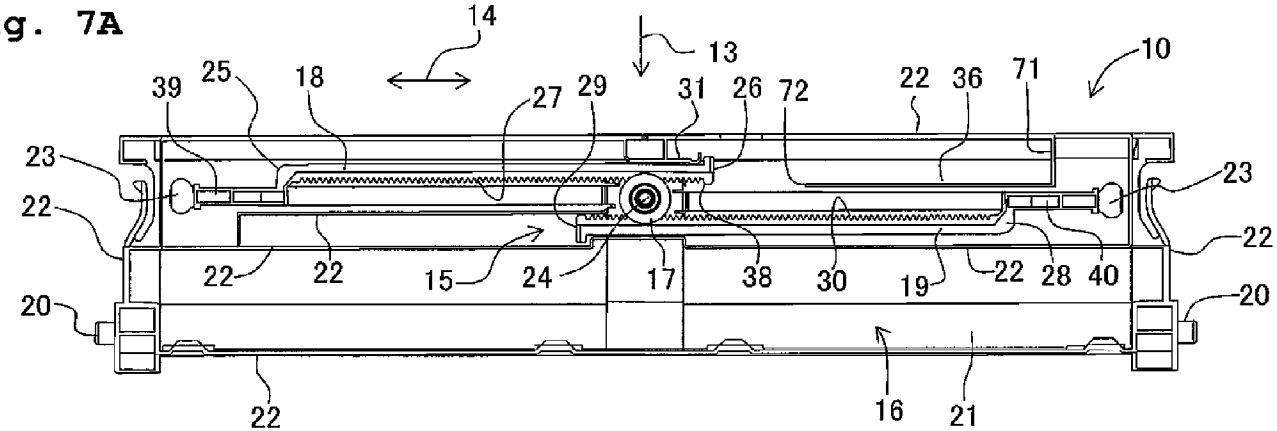
FIG. 7A and FIG. 7B are front views of a sheet guide 70 according to a first modified embodiment of the first embodiment.
Figure 7B:
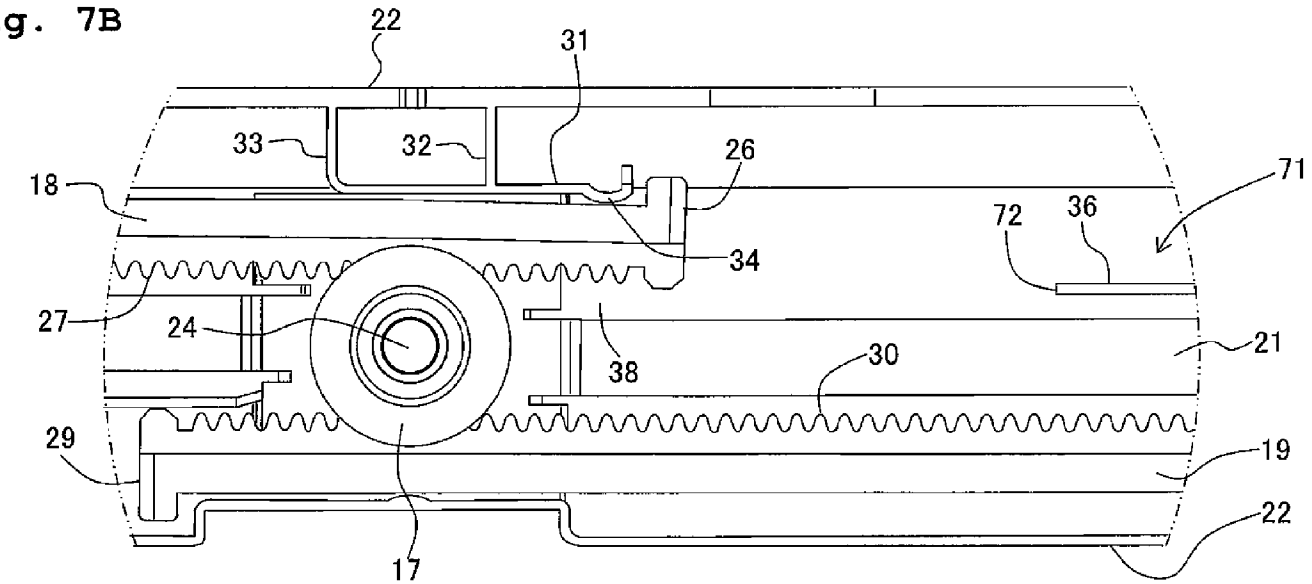

A point at which a sheet guide 70 according to a first modified embodiment of the first embodiment differs from the sheet guide 10 according to the first embodiment is that, in the sheet guide 70, a supporting plate 71 is not extended up to the pinion 17, and is cut off in between. As shown in FIG. 7A and FIG. 7B, an end portion 72 (corresponds to an 'end portion toward the pinion' or an 'end portion facing the pinion' in the first modified embodiment of the first embodiment) of the supporting plate 71, facing the pinion 17 is separated apart from the pinion 17 by a fixed (constant) distance in the sliding direction 14. In this modified embodiment, as shown in FIG. 7B, the supporting plate 71 does not face the pressing arm 31. The rest of the structure is similar to the structure of the sheet guide 10.

As it has been mentioned above, with the span S1 becoming smaller, the supporting-point reactive force Rb increases. However, since the end portion 72 of the supporting plate 71 is separated apart from the pinion 17, when the span S1 becomes smaller than a certain value, the other end portion 26 of the rack 18 is disengaged (separated) from the supporting plate 71. In other words, since the supporting-point reactive force Rb is dissipated, no matter how the rack 18 slides, the force exerted by the pressing arm 31 on the rack 18 does not increase above a certain amount. In other words, the sheet guide 70 according to the first modified embodiment of the first embodiment is capable of changing an attitude between a first attitude and a second attitude which will be described below. In the first attitude, the other end portion 26 of the rack 18 is supported by the supporting plate 71, and in the second attitude, the positioning plates 11 and 12 in pair are separated apart, than in the first attitude, and the other end portion 26 of the rack 18 is not supported by the supporting plate 71. Consequently, even in the first modified embodiment of the first embodiment, smooth coming closer and moving away movement of the positioning plates 11 and 12 is realized, while the collision of the racks 18 and 19 is avoided.

As it has been described above, in the first modified embodiment of the first embodiment, since the supporting plate 71 is provided, even when the amount of deformation of the rack 18 has become substantial, the rack 18 makes a contact with the supporting surface 36, and therefore the collision of the racks is avoided. Moreover, with the span S1 becoming smaller, the supporting-point reactive force Pb increases, and sliding of the rack becomes difficult. However, in the first modified embodiment of the first embodiment, since the end portion of the supporting plate 71, toward the pinion 17 is separated apart from the pinion 17, when the span S1 becomes smaller than a certain value, the other end portion 26 of the rack 18 is moves away from the supporting plate 71. In other words, the supporting-point reactive force Rb is dissipated. Consequently, coming closer and moving away smoothly of the positioning members in pair is realized while the collision of the racks is avoided.

Second Modified Embodiment of First Embodiment

A point at which, a sheet guide 50 according to a second modified embodiment of the first embodiment differs from the sheet guide 10 according to the first embodiment is that, a rear surface 51 of the rack 18 is inclined. The rest of the structure is similar to the structure of the sheet guide 10.

Figure 8A:
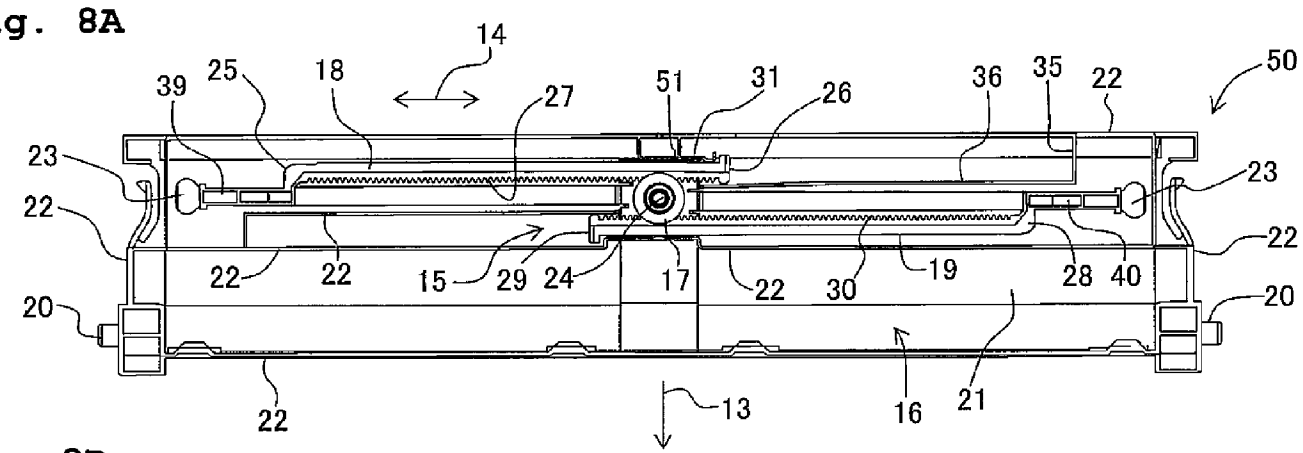
FIG. 8A and FIG. 8B are front views of a sheet guide 50 according to a second modified embodiment of the first embodiment.
Figure 8B:
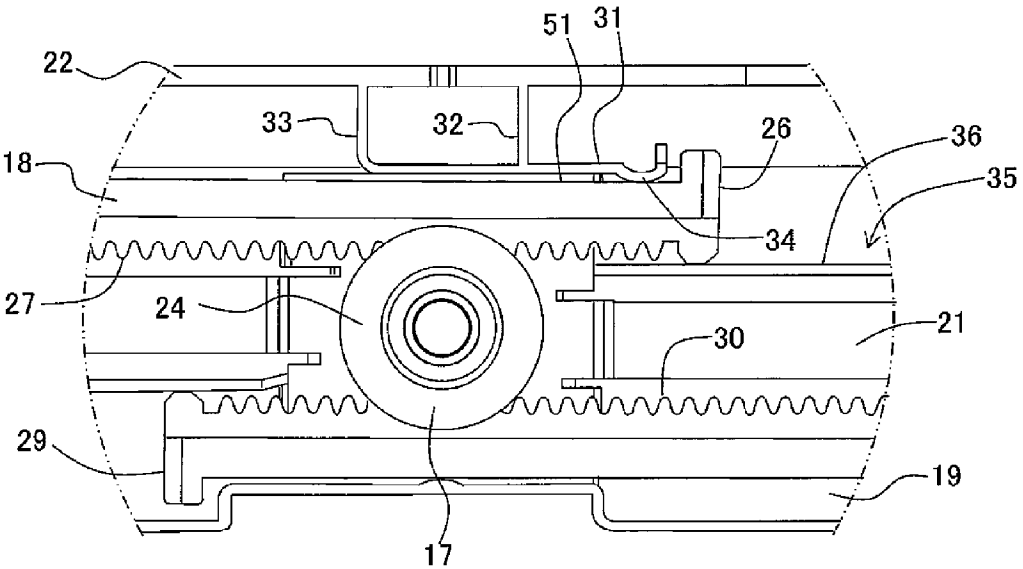

As shown in FIG. 8A and FIG. 8B, the rear surface 51 of the rack 18 is a surface with which, the pressing arm 31 makes a contact, and is a surface being pressed against by the pressing arm 31. Moreover, the rear surface 51 is inclined in a direction of separating apart from the pinion 17, or in other words, a direction opposite to a direction in which, the pressing arm 31 presses the rack 18, with respect to the sliding direction 14, directed from the other end portion 26 of the rack 18 toward the one end portion 39. In other words, the rear surface 51, as coming closer to the other end portion 26, is inclined toward the pressing direction with respect to the sliding direction 14 (refer to FIG. 8B).

Even in the second modified embodiment of the first embodiment, the rack 18 undergoes an elastic deformation by being pressed by the pressing arm 31, with a point of engagement with the pinion 17 as a supporting point. Accordingly, the thrust P is exerted at a point of contact of the rack 18 and the pressing arm 31, and the supporting-point reactive force Rb is generated at the other end portion 26 of the rack 18. Moreover, even when the span 51 between the position at which the thrust P is exerted and the position at which the supporting-point reactive force Rb is exerted has become smaller, since the rear surface 51 of the rack 18 is inclined as mentioned above, the supporting-point reactive force Rb is prevented from becoming extremely substantial. Consequently, coming closer and moving away smoothly of the positioning plates 11 and 12 is realized, while the collision of the racks 18 and 19 is avoided.

As it has been described above, in the second modified embodiment of the first embodiment, since the supporting plate 35 is provided, even when the amount of deformation has become substantial, the rack 18 makes a contact with the supporting surface 36, and the collision of the racks is avoided. Moreover, when the span 51 has become small, the supporting-point reactive force Rb becomes extremely substantial. However, in the second modified embodiment of the first embodiment, since the surface of the rack (the rear surface 51), with which, the pressing arm 31 makes a contact is inclined as mentioned above, the supporting-point reactive force Rb is prevented from becoming extremely substantial. Consequently, coming closer or moving away smoothly of the positioning members in pair is realized while the collision of the racks is avoided.

Second Embodiment

Figure 9A:
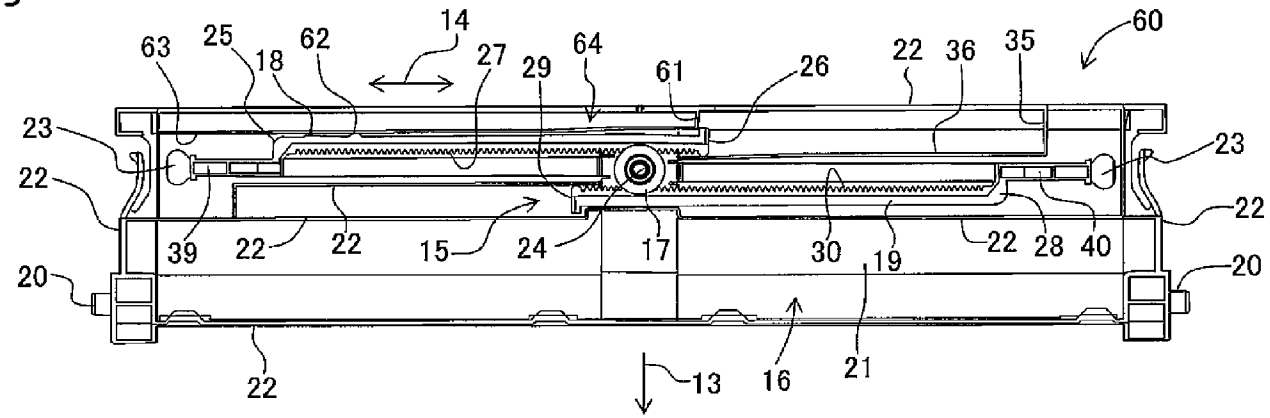
FIG. 9A and FIG. 9B are front views of a sheet guide according to a second embodiment.
Figure 9B:
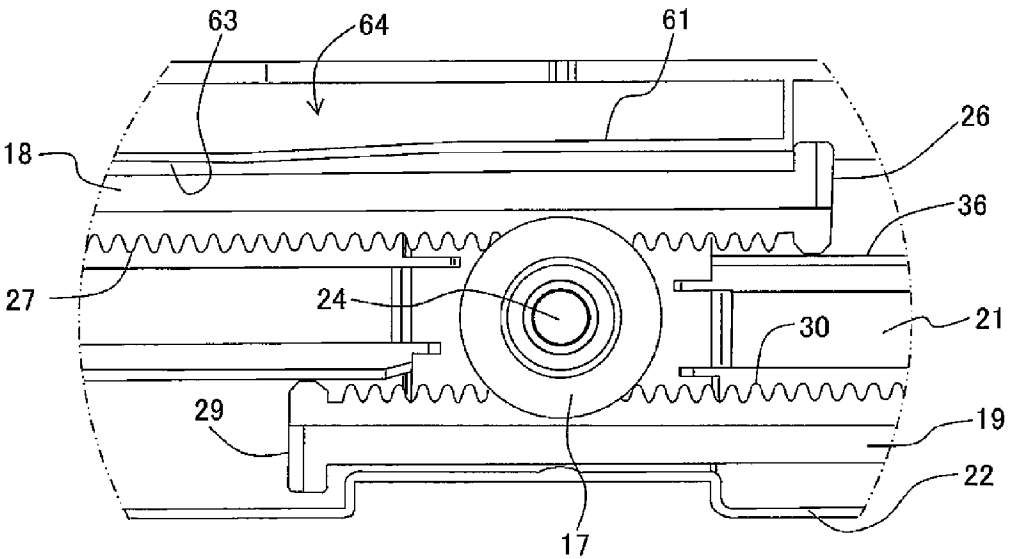

Points at which, a sheet guide 60 according to a second embodiment of the present teaching differs from the sheet guide 10 according to the first embodiment are as follows. As shown in FIG. 9A and FIG. 9B, in the sheet guide 60 according to the second embodiment, a pressing piece (pushing piece) 62 (an example of a 'contact portion' in the second embodiment) is protruded at a predetermined portion of the rack 18, and a supporting plate 61 (an example of 'a supporting member' in the second embodiment) is provided to the reinforcing rib 22 which is arranged at the upstream side of the transporting direction 13, and the pressing piece 62 is pressed against a supporting surface 63 of the supporting plate 61. Accordingly, the rack 18 is pressed by the pinion 17, and a certain resistance is generated against the sliding of the racks 18 and 19. The rest of structure is similar as the structure of the sheet guide 10 according to the first embodiment.

The supporting plate 61 is connected to the reinforcing rib 22 and the main plate 21, and the supporting plate 61, the reinforcing rib 22, and the main plate 21 are formed integrally. The supporting plate 61 is extended in the sliding direction 14 as shown in FIG. 9A and FIG. 9B, and the supporting surface 63 is formed by a lower surface (a surface at the downstream side of the transporting direction 13) of the supporting plate 61. The pressing piece 62 makes a contact with the supporting surface 63, and the supporting surface 63 pushes the pressing piece 62 toward the downstream side (side at which the pinion 17 is arranged) of the transporting direction 13 to urge the lack 18 against the pinion 17. In FIG. 9A and FIG. 9B, a right-end portion of the supporting surface 63, or in other words, an area 64 of the supporting surface 63, near a site at which the pinion 17 is arranged, is inclined. Concretely, as shown in FIG. 9B, in the area 64, the supporting surface 63 is inclined such that, as coming closer to the pinion 17, a distance between the rack 18 and the supporting surface 63 increases gradually. In other words, in the area 64, the supporting surface 63, as moving away from the pinion 17, is inclined in a direction, in which the supporting surface 63 presses the pressing piece 62, with respect to the sliding direction.

As shown in FIG. 9A, the pressing piece 62 is in the form of a block, and is formed integrally with the rack 18. The pressing piece 62 is arranged near the intermediate portion 25 of the rack 18, and protrudes in a direction opposite to the transporting direction 13. In other words, the pressing piece 62 is protruded from the upper surface of the rack 18 (or in other words, a surface on the upstream side of the transporting direction), and is protruded toward an opposite side of the side at which the pinion 17 is arranged (upstream side of the transporting direction 13). In the second embodiment, although the pressing piece 62 is arranged near the intermediate portion 25, it is preferable that a position of the pressing piece 62 is toward the end portion 39, farther than the site of engagement with the pinion 17.

Figure 10A:
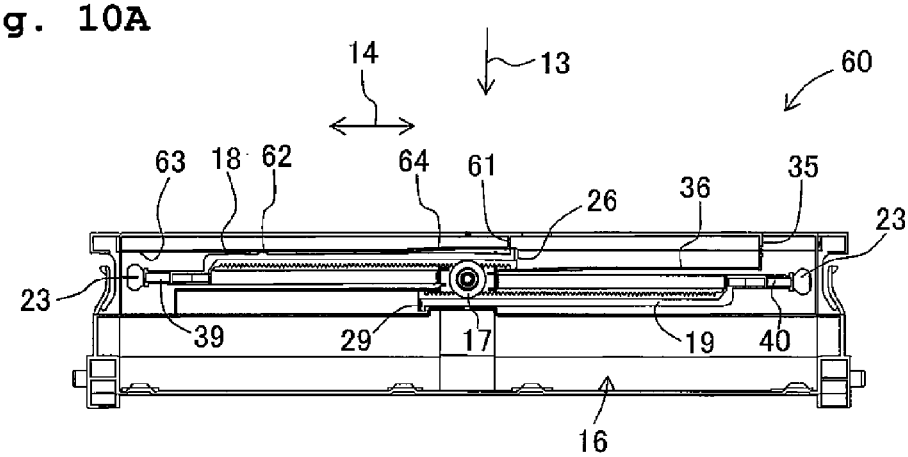
FIG. 10A, FIG. 10B, and FIG. 10C are front views of the sheet guide 60.
Figure 10B:
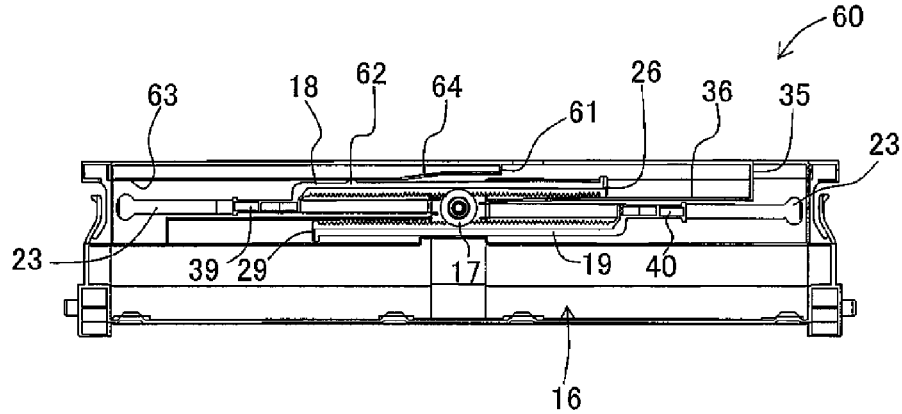
Figure 10C:
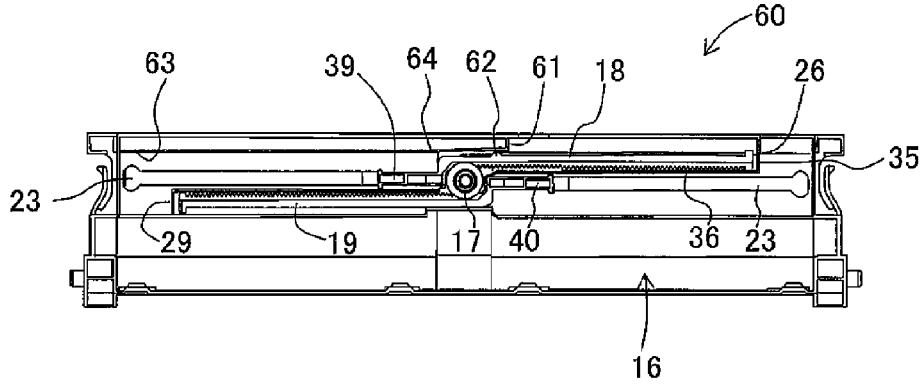

Even in the sheet guide 62 according to the second embodiment, the positioning plates 11 and 12 slide in the sliding direction 14 as shown in FIG. 10A, FIG. 10B, and FIG. 10C, and come closer or move away mutually. Since the pressing piece 62 is protruded from the rack 18, when the racks 18 and 19 slide, the rack 18 is subjected to a thrust P from the supporting plate 61 via the pressing piece 62. Accordingly, the bending moment acts on the rack 18. Moreover, since the site at which the rack 18 and the pinion 17 are engaged becomes a supporting point, the supporting-point reactive force Ra is generated at the supporting point. A frictional force is generated between the rack 18 and the pinion 17 due to the supporting-point reactive force Ra, and due to the frictional force, a resistance is added (developed) against sliding of the rack 18. Even in the second embodiment, the thrust P is exerted only on the rack 18, and an arrangement may be made such that, the thrust P is exerted similarly also to the rack 19.

Even in the second embodiment, since the one end portion 39 of the rack 18 is fitted in the guide groove 23, when the thrust P is exerted to the rack 18, a site at which the rack 18 and the guide groove 23 are fitted becomes the supporting point, and a predetermined supporting-point reactive force Rc is generated at the supporting point. Therefore, the rack 18 is subjected to the supporting-point reactive forces Ra and Rc, and the thrust P. Moreover, when a span S2 between a position at which, the supporting-point reactive force Ra is exerted and a position at which, the thrust P is exerted due to the sliding of the rack 18 has become small, the supporting-point reactive force Ra becomes extremely substantial, and there is a possibility that the smooth sliding of the rack 18 becomes difficult. However, since the supporting surface 63 of the supporting plate 61 is inclined as mentioned above, a shown in FIG. 10C, when the pressing piece 62 of the rack 18 has entered the area 64 of the supporting surface 63, the thrust of the pressing piece 62 becomes small, and the supporting-point reactive force Ra is prevented from becoming extremely substantial. As a result, coming closer and moving away of the positioning plates 11 and 12 can be carried out smoothly.

As it has been described above, in the second embodiment, since at least one of the racks includes the pressing piece 62, the thrust P is exerted from the supporting plate 61 via the pressing piece 62. Concretely, the rack 18 is subjected to a force P of being pressed toward the pinion at a site toward the one end portion 39 farther than the pinion 17, with the site at which the rack 18 supported as a supporting point. Consequently, the bending moment acts on the rack 18, and the supporting-point reactive force Ra is generated at the site (supporting point) of engagement with the pinion 17. A frictional force is generated between the rack 18 and the pinion 17 due to the supporting-point reactive force Ra, and the frictional force becomes the sliding resistance for the rack 18 (the resistance against sliding of the rack 18).

However, the one end portion of the rack 18 is engaged with the sliding guide groove 23. Therefore, when the thrust P is exerted to the rack 18, a supporting point is developed at a site of engagement of the rack 18 and the sliding guide groove 23, and a predetermined supporting-point reactive force Rc is generated. In other words, the rack 18 is subjected to the supporting-point reactive force Ra at the supporting point, the supporting-point reactive force Rc at the site of engagement of the rack 18 and the sliding guide groove 23, and thrust P. Besides, the span S2 between the position at which the thrust P is exerted and the position at which, the supporting-point reactive force Ra is exerted changes with the sliding of the rack 18. Therefore, when the span S2 has become small, the supporting-point reactive force Ra becomes extremely substantial, and there is a possibility that the smooth sliding of the rack becomes difficult. However, since the area of the supporting surface 63, near the pinion 17 is inclined as mentioned above, the supporting-point reactive force Ra is prevented from becoming extremely substantial. Consequently, smooth coming closer and moving away of the positioning plates 11 and 12 in pair is realized.

Modified Embodiment of Second Modified Embodiment

Figure 11A:
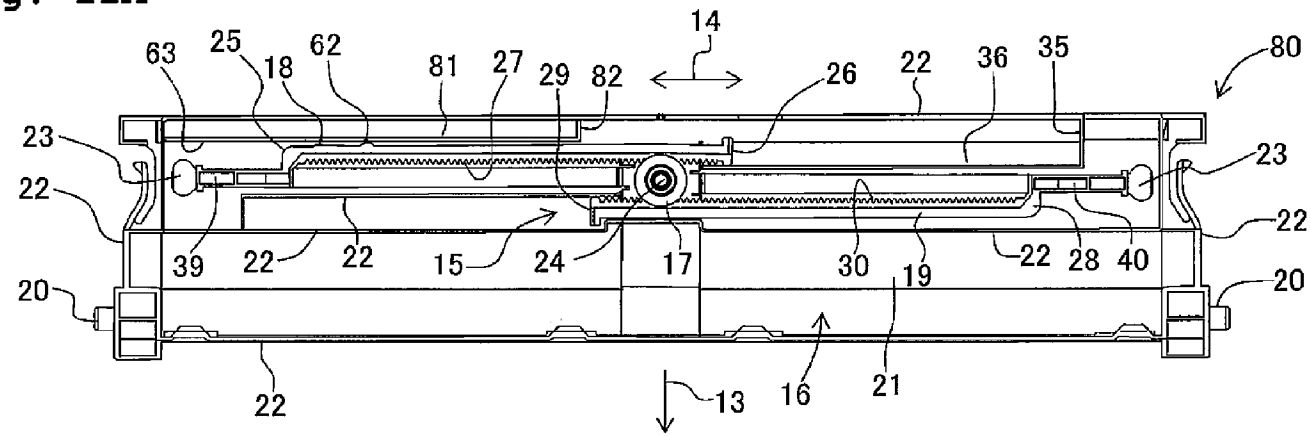
FIGS. 11A and 11B are front views of a sheet guide 80 according to a modified embodiment of the second embodiment.
Figure 11B:
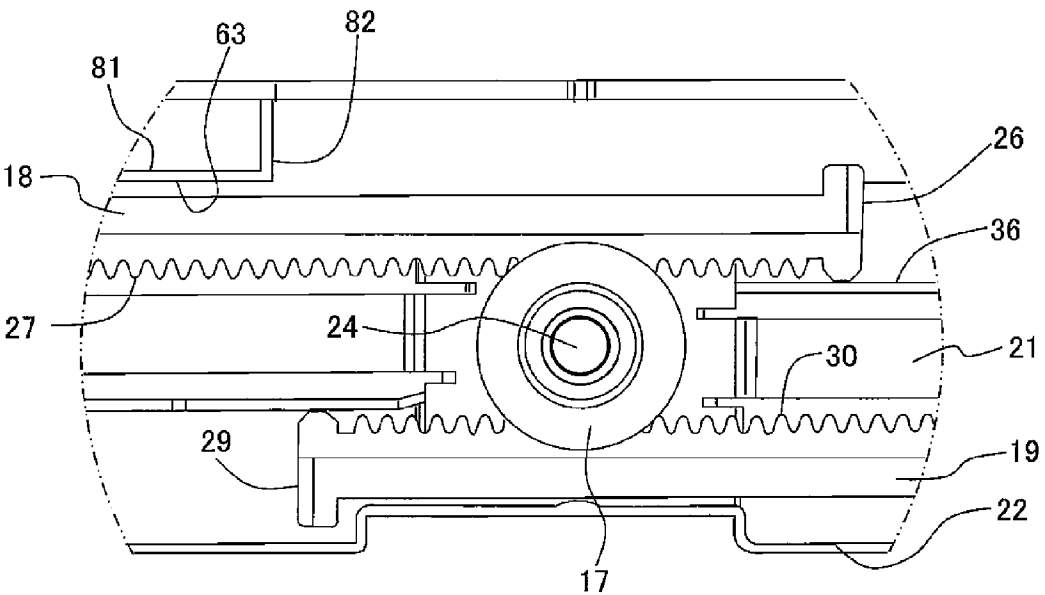

A point at which, a sheet guide 80 according to a modified embodiment of the second embodiment differs from the sheet guide 60 according to the second embodiment is that, a supporting plate 81 is not extended up to the pinion 17, and is cut off in between as shown in FIG. 11A and FIG. 11B. In other words, an end portion 82 (corresponds to an 'end portion toward the pinion' or an 'end portion being closer to the pinion' in the modified embodiment of the second embodiment) of the supporting plate 81 is separated apart from the pinion 17 by a fixed (constant) distance in the sliding direction 14, toward the one end portion 39 of the rack 18. The rest of the structure is similar to the structure of the sheet guide 10 (60).

As it has been mentioned above, when the span S2 between the position at which, the supporting-point reactive force Ra is exerted and a position at which, the thrust P is exerted due to the sliding of the rack 18 becomes small (decreases), the supporting-point reactive force Ra becomes extremely substantial. However, since the end portion 82 of the supporting plate 81 is separated apart from the pinion 17, when the span S2 becomes smaller than a certain value, the pressing piece 62 of the rack 18 is disengaged (separated) from the supporting plate 81. In other words, the sheet guide 80 according to the modified embodiment of the second embodiment is capable of changing an attitude to (between) a first attitude and a second attitude which will be described below. In the first attitude, the pressing piece 62 of the rack 18 is pressed by the supporting plate 81, and in the second attitude, the positioning plates 11 and 12 in pair come closer than in the first attitude, and the pressing piece 62 of the rack 18 is not pressed by the supporting plate 81. In other words, since the supporting-point reactive force Ra decreases, no matter how the rack 18 slides, the smooth coming closer and separating apart movement of the positioning plates 11 and 12 in pair is realized.

The sheet guide according to the first embodiment may be a sheet guide which, simultaneously, has characteristics described in the first modified embodiment and the second modified embodiment of the first embodiment. Moreover, the sheet guide according to the first embodiment may be a sheet guide which, simultaneously, has characteristics described in the second embodiment, and characteristics described in the modified embodiment of the second embodiment. In this manner, the sheet guide according to the embodiments and modified embodiments of the present invention may be a sheet guide in which, characteristics of the embodiments described above and the modified embodiments thereof are combined arbitrarily.

What is claimed is:

1. A sheet guide configured to guide a sheet in a predetermined direction, comprising:

a base on which the sheet is placed;

a pinion which is rotatably provided on the base;

a pair of racks which are extended in a sliding direction perpendicular to the predetermined direction, which face each other sandwiching the pinion therebetween, which are engaged with the pinion to move opposite to each other in the sliding direction by a rotation of the pinion, which have one end portion and the other end portion in the sliding direction respectively, and the pinion being provided between one end portion and the other end portion;

a pair of positioning members which are provided at one end portions of the pair of racks respectively, and which come closer and move away from each other by movement of the pair of racks to position the sheet in the sliding direction;

a sliding guide which is formed in the base, which is slidably engaged with one end portion of each of the pair of racks to guide the pair of racks in the sliding direction;

a contact portion which is provided at a side of at least one rack of the racks opposite to a side engaged with the pinion, and which is protruded at a portion of the at least one rack, the portion being located between one end portion of the at least one rack and an engage site of the at least one rack engaging with the pinion;

a first supporting member which is provided on the base and which is configured to press the contact portion to urge the at least one rack against the pinion; and a second supporting member which is provided on the base and which is configured to support the other end portion of the at least one rack from a side of the at least one rack opposite to a side at which the contact portion is provided, the pinion being provided between the second supporting member and the positioning member provided at one end portion of the at least one rack in the sliding direction.

2. The sheet guide according to claim 1, wherein the first supporting member has a supporting surface which presses the contact portion, and in an area of the supporting surface, near the pinion, as coming closer to the pinion, a distance between the at least one rack and the supporting surface increases.

3. The sheet guide according to claim 1, wherein the first supporting member has a supporting surface which presses the contact portion, and in an area of the supporting surface, near the pinion, the supporting surface, as moving away from the pinion, is inclined toward a pressing direction, in which the contact portion is pressed, with respect to the sliding direction.

4. The sheet guide according to claim 1, wherein one end portion of the first supporting member, which is closer to the pinion than the other end portion of the first supporting member, is away from the pinion such that a force, by which the first supporting member presses the contact portion, is less than a predetermined amount.

5. The sheet guide according to claim 1, wherein the sheet guide changes an attitude between a first attitude and a second attitude, and in the first attitude, the contact portion is pressed by the first supporting member, and in the second attitude, the pair of positioning members come closer than in the first attitude, and the contact portion is not pressed by the first supporting member.

6. An image recording apparatus which records an image on a sheet, comprising:

an image recording section which records an image on the sheet which is transported along a transporting path which has been formed in the image recording apparatus; and a sheet guide according to claim 1, of which a base is connected to the transporting path and which guide the sheet to the transporting path.

* * * * *